US007484648B2

(12) United States Patent
Gschwend et al.

(10) Patent No.: US 7,484,648 B2
(45) Date of Patent: Feb. 3, 2009

(54) COMBUSTION-ENGINED SETTING TOOL

(75) Inventors: Hans Gschwend, Buchs (CH); Ulrich Schiestl, Feldkirch (AT); Nikolaus Hannoschoeck, Grabs (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 11/636,059

(22) Filed: Dec. 8, 2006

(65) Prior Publication Data

US 2007/0138230 A1 Jun. 21, 2007

(30) Foreign Application Priority Data

Dec. 21, 2005 (DE) ..... 10 2005 000 200

(51) Int. Cl.
*B25C 1/08* (2006.01)

(52) U.S. Cl. ..... 227/10; 227/9; 227/11; 123/46 SC

(58) Field of Classification Search ..... 227/9, 227/10, 11; 123/46 SC, 46 R, 46 H
See application file for complete search history.

(56) References Cited

U.S. PATENT DOCUMENTS

| | | | | |
|---|---|---|---|---|
| 6,786,378 | B2 * | 9/2004 | Wagdy et al. | 227/9 |
| 2004/0056063 | A1 * | 3/2004 | Rosenbaum et al. | 227/10 |
| 2004/0134961 | A1 * | 7/2004 | Wolf et al. | 227/10 |
| 2006/0226193 | A1 * | 10/2006 | Toulouse | 227/10 |

* cited by examiner

*Primary Examiner*—Rinaldi I. Rada
*Assistant Examiner*—Nathaniel Chukwurah
(74) *Attorney, Agent, or Firm*—Abelman, Frayne & Schwab

(57) ABSTRACT

A combustion-engined setting tool for driving fastening elements in a constructional component includes at least one combustion chamber (11) for receiving an oxidant-fuel gas mixture, a piston guide (17) located adjacent to the combustion chamber (11), and in which a drive piston (15) for driving the fastening elements in is displaceable by combustion gases, a ventilator for creating turbulence in the combustion chamber (11), and a compression device (30) for compressing gases fed into the combustion chamber (11) and driven by the ventilator drive (21).

6 Claims, 4 Drawing Sheets

COMBUSTION-ENGINED SETTING TOOL

BACKGROUND OF THE INVENTION

1. Field of the Invention

The present invention relates to a combustion-engined setting tool for driving fastening elements such as nails, bolts, pins and the like in a constructional component and including at least one combustion chamber for receiving an oxidant-fuel gas mixture, a piston guide located adjacent to the combustion chamber and in which a drive piston for driving the fastening elements in is displaceable by combustion gases produced by combustion of the oxidant-fuel gas mixture in the combustion chamber, and ventilator means for producing turbulence in the combustion chamber and including a ventilator drive.

2. Description of the Prior Art

Setting tools of the type described above can be driven with gaseous or evaporated liquid fuels that are combusted in the combustion chamber, driving a setting or drive piston for the fastening elements. Generally, with such setting tools, it is desirable to achieve the most possible thermal efficiency.

U.S. Pat. No. 4,403,722 discloses a combustion-engined setting tool with a combustion chamber for combusting a mixture of air and fuel gas and on a rear wall of which a ventilator is arranged. The ventilator is driven by an electric motor, providing a turbulent regime in the combustion chamber during operation of the ventilator, whereby the thermal efficiency is increased in comparison with combustion in a non-turbulent regime.

The drawback of the setting tool of the U.S. Pat. No. 4,403,722 consists in that the combustion in the combustion chamber occurs under the atmospheric pressure, so that peak pressures achieved during combustion usually lie within a range between 5-6 bar. Therefore, the efficiency with reference to the calorific value of the combusted fuel is smaller than 10%.

U.S. Pat. No. 4,415,110 discloses a hand-held setting tool that includes a piston displaceable in a first cylinder and which is connected with a setting piston displaceable in a second cylinder by a gear drive. In the initial position, the piston in the first cylinder is located in the vicinity of a spark plug, whereas the setting piston in the second cylinder is located in an opposite end region remote from the spark plug in the second cylinder. When the setting tool is pressed with a movable arm against a constructional component, the spark plug in the first cylinder ignites the gas-air mixture therein. As a result, the piston in the first cylinder moves away from the spark plug, whereby the gear drive displaces the setting piston in the second cylinder toward the spark plug therein, compressing the gas-air mixture in the second cylinder. Then, the gas-air mixture in the second cylinder is also ignited by the spark plug therein, with the setting piston being accelerated in a direction away from the spark plug in the second cylinder, driving, with its stem, a fastening element into the constructional component. The combustion pressure is increased due to the pre-compression of the gas-air mixture.

The drawback of the setting tool of U.S. Pat. No. 4,415,110 consists in that the stem of the setting piston, in its initial position at the end region of the second cylinder remote from the spark plug, is located in the nail guide, blocking feeding of a new nail. Therefore, little time is available for feeding a new nail in the nail guide when the setting piston is located in the region of the second cylinder adjacent to the spark plug therein. This is critical when longer nails are being driven in, and it can lead to malfunction of the setting tool.

Accordingly, an object of the present invention is to provide a setting tool in which the drawbacks of the known setting tools are eliminated, and a high thermal efficiency is achieved.

SUMMARY OF THE INVENTION

This and other objects of the present invention, which will become apparent hereinafter, are achieved by providing in the setting tool of the type described above a compression device for compressing gases fed into the combustion chamber and driven by the ventilator drive. Preferably, the ventilator drive is formed by an electric motor.

The compression device provides for compression of the oxidant-fuel gas mixture in the compression chamber, without a need for an additional drive for the compression device.

According to an advantageous embodiment of the present invention the compression device includes a charging cylinder to which fuel and oxidant are delivered, and a displacement body, displaceable in the charging cylinder and connectable with the ventilator drive. The charging cylinder is constructively very simple and provides for an easy sealing of the displacement body.

Advantageously, the take-off drive of the ventilator drive is connected with a gear drive that is connected with operational elements for the displacement body by an appropriate coupling. The foregoing measure insures that the drive energy necessary for the compression device is taken off the ventilator drive only for a short time, which reduces losses to a minimum. The drive connection between the ventilator drive and the compression device can be turned on and off by the coupling, so that the drive energy for the compression device is taken off only when necessary.

According to a technically simple reversible construction of the operational elements for the compression device, those include a rope and a rope pulley, with the rope being attached to the displacement body and wound on the pulley. The rope is connected with the gear drive either by the coupling or directly.

Advantageously, the compression device includes at least one return element, e.g., a spring for the displacement body and which returns the displacement body to its initial position after the completion of the compression stroke.

According to further advantageous embodiment of the present invention, the displacement body is formed as a piston having a through-channel, and the setting tool includes means for closing the through-channel. The through-channel extends through the piston in the axial direction from one end surface to another end surface, connecting the space in front of and behind the piston.

Advantageously, the compression device includes valve means having a first position in which the charging cylinder is flowwise separated from the combustion chamber, and a second position in which the charging cylinder is flowwise connected with the combustion chamber. This provides a controllable connection of the charging cylinder with the combustion chamber.

Advantageously, the valve means includes an actuator cooperating with at least one driver element of a component displaceable relative to the charging cylinder for displacing the valve means from the first position to the second position upon the setting tool being pressed against a constructional component, and from the second position to the first position upon lifting of the setting tool off the constructional component. The displaceable component can be formed, e.g., by a guide sleeve in which the piston guide is located, or another element of the press-on string. Thereby, the valve means is automatically controlled in a technically simple manner by the setting tool being pressed against or being lifted off the constructional component.

The novel features of the present invention, which are considered as characteristic for the invention, are set forth in the appended claims. The invention itself, however, both as to its construction and its mode of operation, together with additional advantages and objects thereof, will be best understood from the following detailed description of the preferred embodiments, when read with reference to the accompanying drawings.

DETAILED DESCRIPTION OF THE PREFERRED EMBODIMENT

Figure 1:
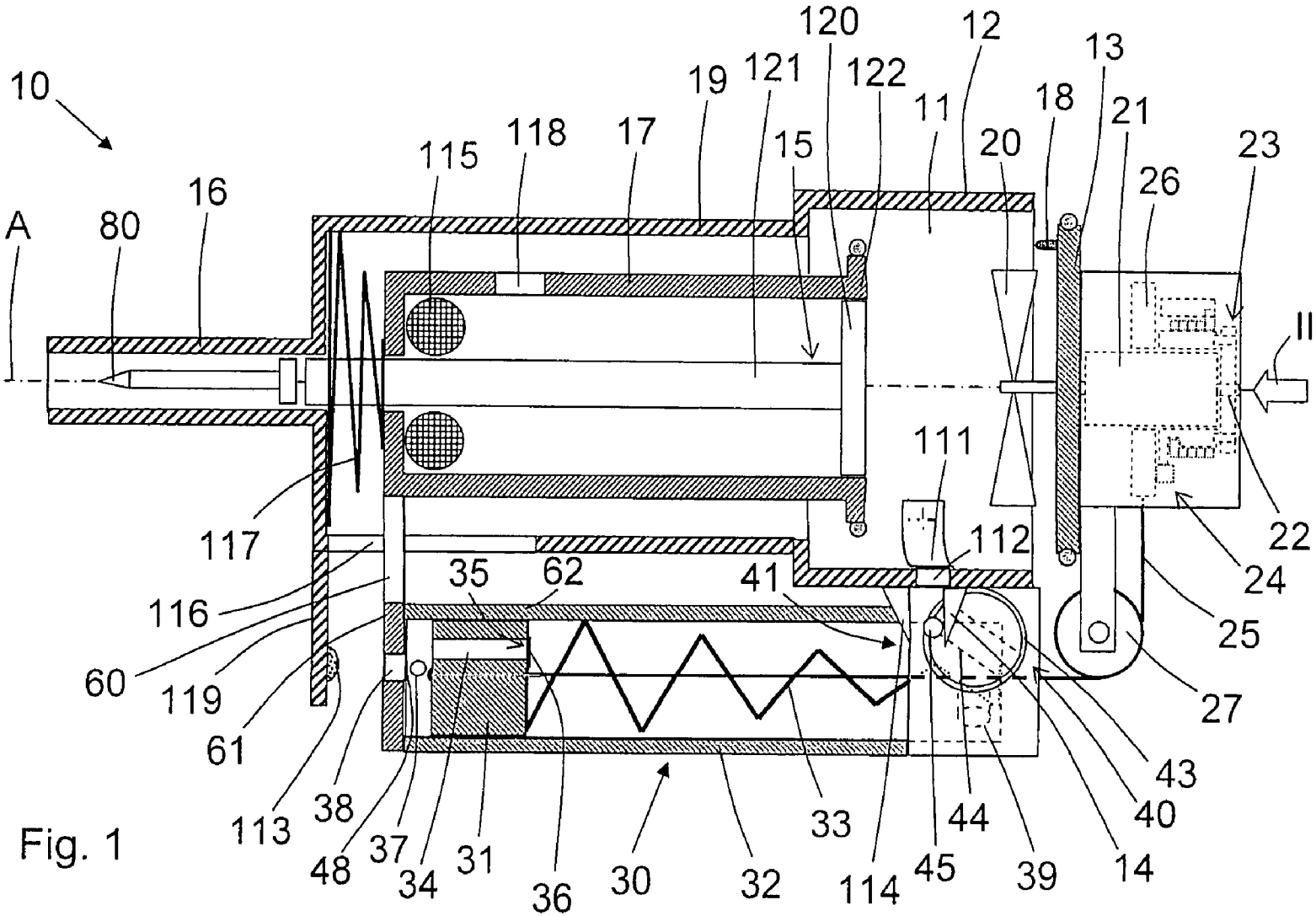
FIG. 1 a partially cross-sectional side view of a setting tool according to the present invention in its initial position.
Figure 2:
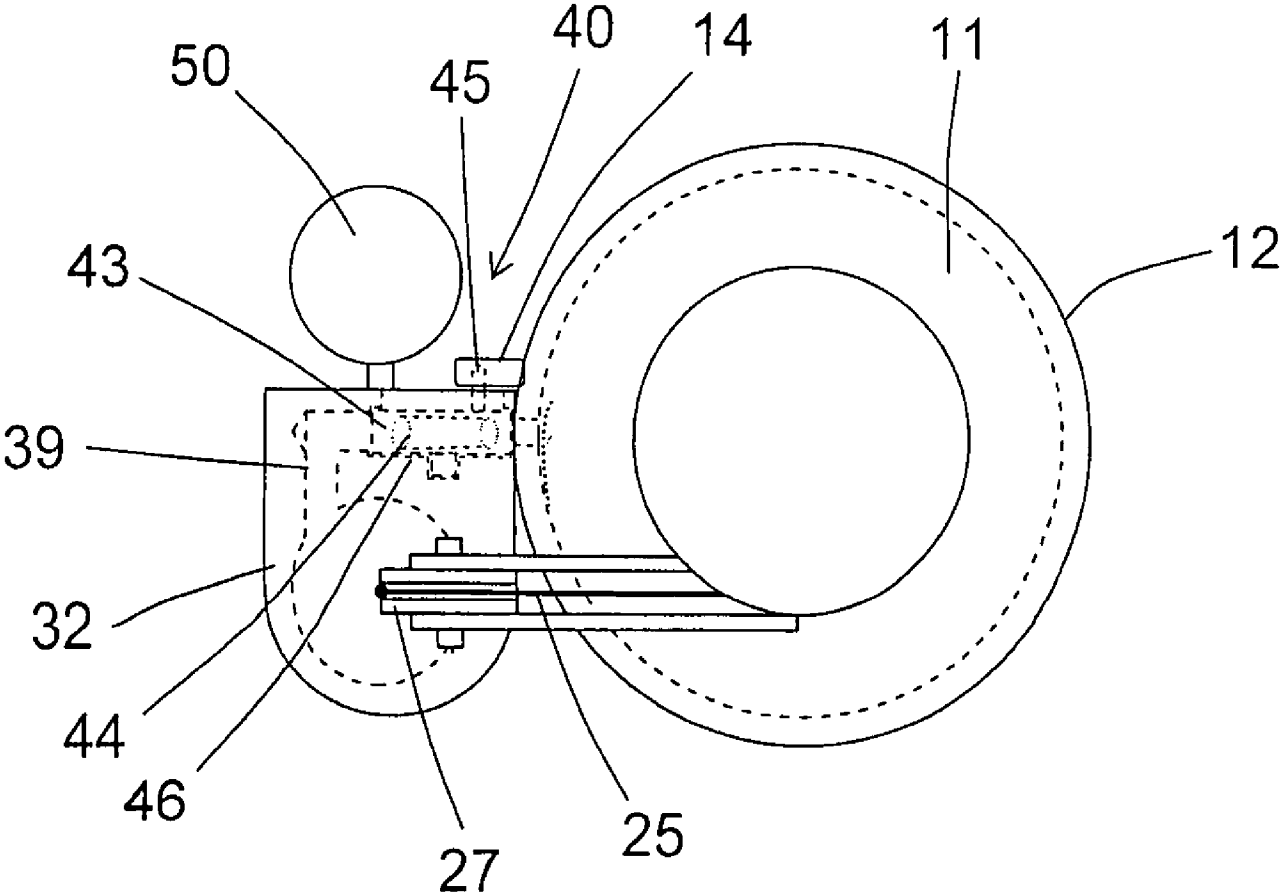
FIG. 2 a view of the setting tool shown in FIG. 1 in the direction of arrow II.

A setting tool 10 according to the present invention, which is shown in FIGS. 1-4, can operate with a fuel gas or an evaporated liquid fuel. The setting tool 10 includes a setting mechanism with which a fastening element 80 such as nail, bolt, etc. is driven in a constructional component U when the setting tool 10 is pressed against the constructional component with its bolt guide 16 or its nose part.

The setting mechanism includes, among others, a combustion chamber 11 formed in a combustion chamber sleeve 12 and which is closed by closing means 13 formed as a rear wall plate, a piston guide 17 in which a drive piston 15 is displaceably arranged, and a bolt guide 16 for guiding the fastening element 80. The drive piston 15 has a stem 121 that drives the fastening element 80. The piston guide 17 is formed as an elongate cylinder that defines a longitudinal axis A of the setting tool 10. The piston guide 17 and the closing means 13 are connected with each other and form a first structural unit. A guide sleeve 19, which at least partially surrounds the piston guide 17, is displaceably arranged relative to the first structural unit of the piston guide 17 and the closing means 13. At the end of the piston guide 17 adjacent to the bolt guide 16, there is provided a damping element 115. The damping element 115 forms a stop for the drive piston 15 in its lower dead point. In the piston guide 17, there is formed a side outlet opening 118 through which during the setting process air located in front of the drive piston 15 and, subsequently, combustion gases located behind the drive piston 15 are removed.

On the guide sleeve 19, on its end adjacent to the closing means 13, the guide chamber sleeve 12 is formed. Alternatively, the guide chamber sleeve 12 can be fixedly secured on the end of the guide sleeve 12 adjacent to the closing means 13. The bolt guide 16, the guide sleeve 19, and the combustion chamber sleeve 12 form together a second structural unit extending in the direction of the longitudinal axis A. The piston guide 17 is supported at its end remote from the combustion chamber 11 by a spring 117, with an end of the guide sleeve 19 adjacent to the bolt guide 16 being supported against the opposite end of the spring 117.

Fastening elements can, e.g., be stored in a magazine provided on the setting tool 10 (not shown).

In the combustion chamber 11, there is further provided an ignition device 18, e.g., a spark plug, for igniting the oxidant-fuel mixture fed into the combustion chamber 11 for effecting a setting process. The feeding of the fuel in the combustion space or the combustion chamber 11 is effected from a fuel reservoir (not shown in the drawings) such as, e.g., a replaceable gas flask, through a metering device 50, e.g., a mechanical or electronic metering valve (please see FIG. 2).

In the transition region between the combustion chamber 11 and the piston guide 17, there can be arranged magnets (not shown) for retaining the drive piston 15 with a predetermined holding force in its initial position at the end of the piston guide 17.

The setting tool 10 further includes a ventilator 20 located in the combustion chamber 11 and driven by a ventilator drive 21 formed as an electric motor. The ventilator 20 serves, in the embodiment shown in the drawings, on one hand, for generating a turbulent flow regime in the combustion chamber 11 when the combustion chamber 11 is closed and, on the other hand, for aeration and flushing of the combustion chamber 11 after completion of the setting process in the open condition of the combustion chamber.

The setting tool 10 also includes a compression device 30 also driven by the ventilator drive 21 as it would be explained further below. The compression device 30 serves for a short-time feeding of the oxidant-fuel mixture into the combustion chamber 11, with the oxidant-fuel mixture being contained in the combustion chamber 11 under pressure which is above the atmospheric pressure. As an oxidant, e.g., air oxygen can be used.

The compression device 30 includes a charging cylinder 32 that extends parallel to the longitudinal axis A and is fixedly connected with the piston guide 17 by a connection element 60. In order for the guide sleeve 19 to be able to be displaced relative to the unit piston guide 17 and charging cylinder 32, a slot 116 is formed in the guide sleeve 19 through which the connection element 60 extends. In the charging cylinder 32, a displacement body 31, which is formed as a piston, is displaceably arranged. The circumferential surface of the displacement body 31 sealingly abuts the cylindrical inner surface of the charging cylinder 32. The displacement body 31 is supported by the elastic return means 33 against an end of the charging cylinder 32 adjacent to the combustion chamber 11. The elastic return means 33 is formed as a spring. At the end of the combustion chamber 11 adjacent to the charging cylinder 32, there is provided valve means 40. The valve means 40 includes a rotatable body 43 in which a channel 44 is formed and which is supported rotatably and medium-tight in a receptacle 46. The rotatable body 43 can be set in rotation with an actuator 45. To this end, drive means 14, 114 for the actuator 45 are provided on the displaceable combustion chamber sleeve 12 displaceable relative to the valve means 40.

In the charging cylinder 32, in the region of the valve means 40, there is formed an outlet 39 that is connected, in the second position 42 (see FIGS. 3 and 4) of the valve means 40, by a channel 44 with an inlet channel 112 opening into the combustion chamber 11. In the first position 41 of the valve means 40 shown in FIG. 1, the rotatable body 43 closes the communication between the outlet 39 and the inlet channel 112. In the combustion chamber 11. There is further provided a combustion chamber valve 111 which is formed as a check valve and which pressure-tightly closes the inlet channel 112 during the combustion process.

In the end region of the charging cylinder 32 remote from the valve means 40, there is formed, in the cylinder wall 62 of the charging cylinder 32, an inlet 37 through which the charging cylinder 32 is connected, via metering device 50, with the fuel reservoir. In the end wall 61 of the charging cylinder 32, there is further provided a second inlet 38 through which air is fed in the charging cylinder 32. For the second inlet 38, there is further provided, in the charging cylinder 32, a second valve 48 which is formed as a check valve and which provides for entry of air in the charging cylinder 32 but prevents exit of gases from the charging cylinder 32 through the second inlet 38. Actuation means in form of a rope 25 is attached to the displacement body 31 and which displaces the displacement body 31 against the return means 33. To this end, the rope 25 is connectable with the ventilator drive 21, as it would be described in more detail further below.

A through-channel 34 extends from one end surface of the displacement body 31 to another end surface thereof. At an opening 35 of the through-channel 34 adjacent to the valve means 40, there is provided a first valve 36 formed as a check valve. The first valve 36 closes the channel 34 of the displacement body 31 when the displacement body 31 is displaced against the return means 33.

In the transition region between the guide sleeve 19 and the bolt guide 16, there is provided a closing element 119 which is formed, e.g., as a cap plate of the guide sleeve 19 and on which a seal 113 for the second inlet 38 of the charging cylinder is arranged.

The ventilation drive 21 is connected by a further take-off drive 22 with, e.g., a gear drive 23 formed as a planetary gear drive. The gear drive 23 is connected with a rope pulley 26 by a coupling 24 formed, e.g., as a wrap spring coupling. The pulley 26 supports the above-mentioned rope 25 which is wound thereabout. The rope 25 is guided and deflected, along the path between the rope pulley 26 and the displacement body 31, by at least one guide roller 27. In FIG. 1, the setting tool 10 is shown in its initial position in which the drive piston 15 with the piston head 120 is located in its upper dead point position at the end of the piston guide 17 adjacent to the combustion chamber 11. The combustion chamber 11 is open, i.e., the closing means 13 and a combustion chamber wall 122, which is provided on the piston guide 17, are lifted off the combustion chamber sleeve 12. The combustion chamber 11 is flushed with fresh air in this position. The charging cylinder 32 is filled with a concentrated fuel/air mixture which is subjected to the environmental pressure, and the displacement body 31 is located, in its initial position in the vicinity of the inlets 37, 38. The valve means 40 occupies its first position 41. A fastening element 80 is located in the bolt guide 16. The spring 117 and the return means 33 are essentially in the release position.

Figure 3:
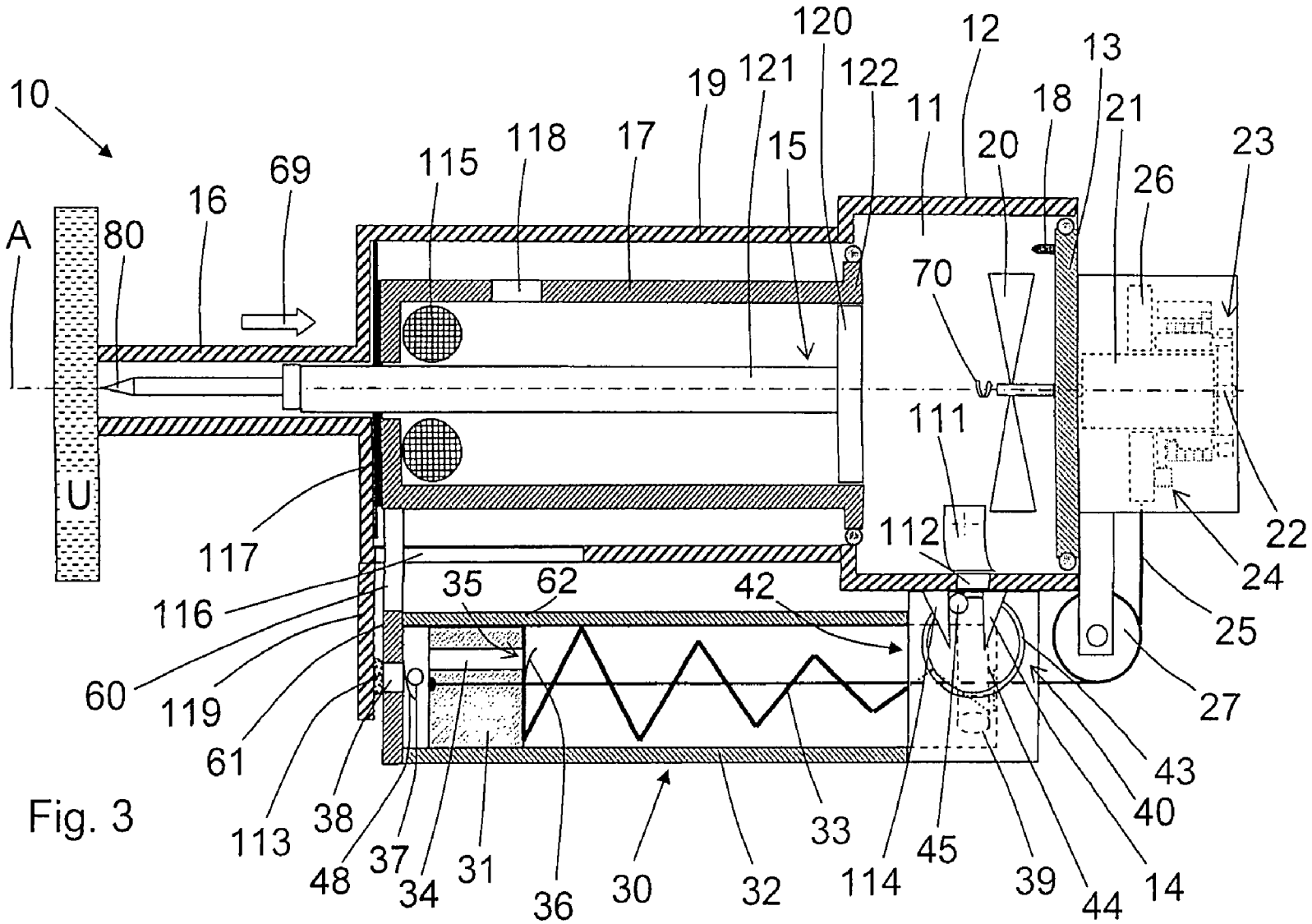
FIG. 3 a view similar to that of FIG. 1 with the setting tool being pressed against a constructional component.

Upon the setting tool 10 being pressed against a constructional component U, as shown in FIG. 3, the guide sleeve 19 is displaced, together with the bolt guide 16 and the combustion chamber sleeve 12 in the direction of arrow 69, whereby the spring 117 between the combustion chamber sleeve 12 and piston guide 17 becomes compressed. The combustion chamber sleeve 12 is displaced into a sealing abutment with the combustion chamber wall 122 and the closing means 13, so that the combustion chamber 11 becomes close. Simultaneously, the ventilator drive 21 is actuated with a switch (not shown). The ventilator 20 and the gear drive 23 thereby are set in rotation in the direction of arrow 70. However, the rope pulley 26 does not move because the coupling 24 has not yet connected the gear drive 23 with the rope pulley 26. The driver 114, which is secured on the combustion chamber sleeve 12, actuates the actuator 45 of the valve means 40, and the rotatable body 43 is pivoted to a position in which the channel 44 connects the outlet 39 of the charging cylinder 32 with the inlet channel 112 of the combustion chamber 11. The valve means 40 is displaced into its second position 42.

Figure 4:
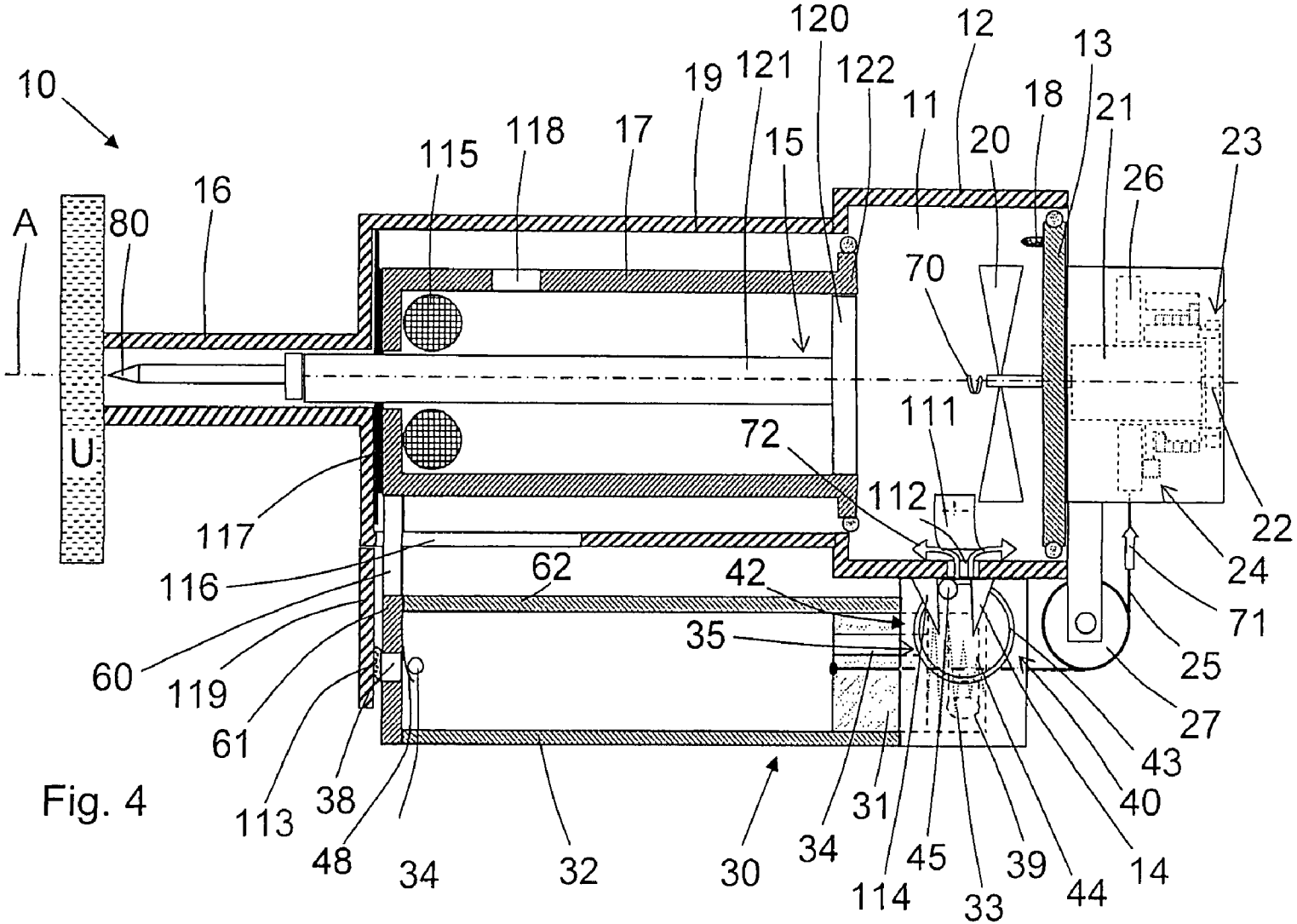
FIG. 4 a view similar to that of FIG. 3 with the operating ventilator.

FIG. 4 shows a position in which the setting tool 10 is actuated with a switch, not shown, which is usually mounted on the setting tool handle, likewise not shown. Upon actuation of the setting tool actuation switch, the coupling 24 is also actuated, connecting the rotating gear drive 23 of the ventilator drive 21 with the rope pulley 26. Upon rotation of the pulley 26, the rope 25 is pulled in the direction of arrow 71 and is wound on the pulley 26. Thereby, the displacement body 31 is displaced from its initial position shown in FIG. 1 to its end position, as shown in FIG. 4, in which it is located at an opposite end of the charging cylinder 32 adjacent to the valve means 40. In this position of the displacement body 31, the opening 35 of the through-channel 34 is closed by the valve 36.

As a result, the concentrated fuel-air mixture, which is contained in the charging cylinder 32, is pressed through the outlet 39 of the charging cylinder 32, the channel 44 in the rotatable body 43, and the inlet channel 112, in the direction of arrow 22 into the combustion chamber 11, with the combustion chamber valve 111 occupying an open position. As soon as the displacement body 31 reaches its end position, the rope pulley becomes decoupled from the gear drive 23 by the coupling 24. However, the process of charging the combustion chamber 11 with the fuel-air mixture continues, due to the operation of the ventilator drive 21 and the rotational energy stored in the gear drive 23, usually for 10-50 msec, whereby the fuel-air mixture is isentropically compressed, i.e., without release of heat. The combustion process is actuated in response to a time-delayed ignition pulse which is generated upon actuation of the setting tool actuation switch which actuates the ignition device 18. Because the start of the combustion takes place only at a high initial pressure in the combustion chamber 11 that exceeds the environmental pressure, e.g., at 1.5-3 bar, high combustion pressure are achieved, resulting in a more rapid acceleration of the drive piston 15. Thus, the fastening element 80 is only driven in the constructional component U by the drive piston 15 with high energy.

Simultaneously with the actuation of the setting actuation switch that initiates the compression process, a predetermined amount of fuel is injected by the metering device 50 (FIG. 2) through the first inlet 37 into space of the charging cylinder 32 behind the displacement body 31 movable to its end position. Because the volume of this space rapidly increases in a short compression time (due to rapid movement of the displacement body 31), a high vacuum is produced which provides for a rapid and complete, dependent on the temperature, evaporation of the fuel (such as, e.g., liquefied gas).

Upon lifting of the setting tool 10 off the constructional component U, the spring 117 displaces the guide sleeve 19 away from the piston guide 17, whereby the sealing element 113 releases the second inlet 38 of the charging cylinder 32. The combustion chamber 11 becomes open, and the ventilator 20 provides for flow of fresh air into the combustion chamber 11. Simultaneously with the lifting of the setting tool 10 off the constructional component U and opening of the second inlet 38, fresh air also fills, through the second inlet 38, the charging cylinder 32 and is mixed with the fuel that was brought into the charging cylinder before. Also, with the lifting of the setting tool 10 off the constructional component U, the driver 14 on the combustion chamber sleeve 12 actuates the actuator 45 of the valve means 40, whereby the rotatable body 43 is rotated in the opposite direction, separating the outlet 39 and the inlet channel 112 of the combustion chamber 11, with the valve means 40 now occupying, again, its first position 41 (FIG. 1).

Upon release of the setting tool actuation switch, the return means 33 displaces the displacement body 31 to its initial position in the vicinity of the first and second inlets 37 and 38. The fuel-air mixture in the space between the inlets 37 and 38 flows through the open through-channel 34 into the space on the opposite side of the displacement body 31. The flow of the fuel-air mixture outwardly through the second inlet 38 is prevented by the second valve 48.

When a new fastening element 80 is brought in the bolt guide 16, the setting tool 10 is ready to perform another setting cycle.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A setting tool for driving fastening elements in a constructional component, comprising:

at least one combustion chamber (11) for receiving an oxidant-fuel gas mixture;

a piston guide (17) located adjacent to the combustion chamber (11);

a drive piston (15) for driving the fastening elements in and displaceable in the piston guide (17) by combustion gases produced by combustion of the oxidant-fuel gas mixture in the combustion chamber (11);

ventilator means (20) for producing turbulence in gases in the combustion chamber (11) and including a ventilator drive (21);

a compression device (30) for compressing gases fed into the combustion chamber (11), the compression device being driven by the ventilator drive (21), wherein the compression device (30) includes a charging cylinder (32) to which fuel and oxidant are delivered, and a displacement body (31) displaceable in the charging cylinder (32) and connectable with the ventilator drive (21); and a gear drive (23) connected with a take-off drive (22) of the ventilator drive (21), and a coupling (24) connecting the gear drive (23) with operational means for the displacement body (31).

2. A setting tool according to claim 1, wherein the operational means for the displacement body (31) includes a rope (25) and a rope pulley (26) therefore.

3. A setting tool according to claim 1, wherein the compression device (30) further comprises return means (33) for the displacement body (31).

4. A setting tool according to claim 1, wherein the displacement body (21) is formed as a piston having a through-channel (34), and the setting tool (10) comprises means for closing the through-channel (34).

5. A setting tool according to claim 1, wherein the compression device (30) includes valve means (40) having a first position (41) in which the charging cylinder (32) is flowwise separated from the combustion chamber (11), and a second position (42) in which the charging cylinder (32) is flowwise connected with the combustion chamber (11).

6. A setting tool according to claim 5, wherein the valve means (40) comprises an actuator (44) cooperating with at least one drive element (14, 114) of a component displaceable relative to the charging cylinder (32) for displacing the valve means (40) from the first position (41) to the second position (42) upon the setting tool (10) being pressed against a constructional component (U) and from the second position (42) to the first position (41) upon lifting of the setting tool (10) off the constructional component.

* * * * *